US007671807B2

(12) United States Patent
Fu et al.

(10) Patent No.: US 7,671,807 B2
(45) Date of Patent: Mar. 2, 2010

(54) HIGH-DIRECTIONAL WIDE-BANDWIDTH ANTENNA

(75) Inventors: I Ju Fu, Taoyuan (TW); Yung Chih Lo, Changhua (TW); Yao Jen Chen, Kaohsiung (TW)

(73) Assignee: Amos Technologies Inc., Hsinchu 300 (TW)

( * ) Notice: Subject to any disclaimer, the term of this patent is extended or adjusted under 35 U.S.C. 154(b) by 149 days.

(21) Appl. No.: 12/078,828

(22) Filed: Apr. 7, 2008

(65) Prior Publication Data

US 2009/0051599 A1 Feb. 26, 2009

(30) Foreign Application Priority Data

Aug. 22, 2007 (TW) ..... 96131092 A

(51) Int. Cl.
*H01Q 1/38* (2006.01)

(52) U.S. Cl. ..... 343/700 MS

(58) Field of Classification Search ..... 343/700 MS, 343/702, 846

See application file for complete search history.

(56) References Cited

U.S. PATENT DOCUMENTS

| | | | | |
|---|---|---|---|---|
| 6,476,769 | B1 * | 11/2002 | Lehtola | 343/702 |
| 6,765,539 | B1 * | 7/2004 | Wang et al. | 343/795 |
| 6,961,028 | B2 * | 11/2005 | Joy et al. | 343/895 |
| 2004/0090378 | A1 * | 5/2004 | Dai et al. | 343/700 MS |

* cited by examiner

*Primary Examiner*—Hoang V Nguyen
(74) *Attorney, Agent, or Firm*—Bacon & Thomas, PLLC

(57) ABSTRACT

A high-directional wide-bandwidth antenna is disclosed. The high-directional wide-bandwidth antenna includes a first element, a first radiating body, a second radiating body, a third radiating body, and a fourth radiating body. The first element has a first feeding point, wherein its equivalent reactance is inductive. One end of the first radiating body is connected to the first element and the other end of the first radiating body is a coupling surface. The second radiating body has a second feeding point and is extended through the second feeding point to the coupling surface so that the energy is transferred between the first radiating body and the second radiating body through the coupling surface. The first resonant frequency is attained by the first radiating body and the second radiating body, and the second resonant frequency is attained by the third radiating body and the fourth radiating body.

16 Claims, 5 Drawing Sheets

HIGH-DIRECTIONAL WIDE-BANDWIDTH ANTENNA

FIELD OF THE INVENTION

The present invention is related to an antenna, and more particularly to a high-directional wide-bandwidth antenna for using in a radio-frequency identification (RFID) tag.

BACKGROUND OF THE INVENTION

A Radio-frequency identification (RFID) tag is composed of a RFID IC and an antenna, wherein the RFID IC can be used to store information such as the product type, location, and date. To read/write information from/into the RFID IC, it is necessary to perform read/write operation to the RFID IC in a contactless manner. Because RFID tag can be used to transmit data in a wireless fashion, it has been widely employed in a variety of fields, such as door access control, ticket vending, antitheft application, logistic management, and pet identification.

Referring to FIG. 1, a conventional antenna for RFID tag is shown. The antenna 1 for using in a RFID tag includes a loop element 11 and a radiating body 12, wherein an annular path is formed between a first feeding point 111 and a second feeding point 112 of the loop element 11. The loop element 11 has an outer side A coupled with the radiating body 12. The radiating body 12 extends outwardly from the side A and bent several times for receiving or transmitting radio waves. The RFID IC (not shown) is connected to the first feeding point 111 and the second feeding point 112. Energy can be transferred to the antenna 1 through the first feeding point 111 and the second feeding point 112. Also, the radio signals received by the antenna 1 can be transferred to the RFID IC through the first feeding point 111 and the second feeding point 112.

The first feeding point 111 and the second feeding point 112 will generate an equivalent inductive reactance therebetween, and the RFID IC will function as a capacitive element. When the RFID IC is connected to the first feeding point 111 and the second feeding point 112, a conjugate-matching compensating effect is generated. Therefore, the RFID IC can effectively transfer the energy to the loop element 11, and thus the loop element 11 can transfer the energy to the radiating body 12 by coupling.

However, the conventional antenna 1 for using in a RFID tag can be used at a single resonant frequency. Therefore, the bandwidth of antenna is small and thus the antenna can be used at a single frequency only. Moreover, the conventional antenna is a non-array type antenna, and its directionality is quite low. This would result in a short reading distance for RFID tag. Therefore, how to develop a high-directional wide-bandwidth antenna for using in a RFID tag is an urgent task.

SUMMARY OF THE INVENTION

The present invention provides a high-directional wide-bandwidth antenna for RFID tag, wherein the antenna employs two resonant frequencies so that the bandwidth of the antenna can be employed for multi-frequency RFID tag. The frequency bandwidth of the antenna according to the invention can be ranged from 862 MHz to 1006 MHz. Also, the antenna according to the present invention is an array type antenna, so that it has a high directionality and the reading distance of the RFID tag is lengthened.

The present invention is accomplished by a high-directional wide-bandwidth antenna for using in a RFID tag. The inventive antenna comprises a first element composed of a conductor and having one end serving as a first feeding point, wherein the electricity of the first feeding point is equivalent to an inductive reactance; a first radiating body having one end connected with the first element and the other end being a coupling surface; a second radiating body having one end serving as a second feeding point, wherein the second radiating body extends to the coupling surface of the first radiating body through the second feeding point so that energy can be transferred between the first radiating body and the second radiating body through the coupling surface; a third radiating body having one end connected with the first radiating body and the first element and the other end extending outwardly; and a fourth radiating body having one end connected with the first radiating body, the third radiating body and the first element and the other end extending outwardly, wherein the first radiating body and the second radiating body attain a first resonant frequency, and the third radiating body and the fourth radiating body attain a second radiating frequency.

Now the foregoing and other features and advantages of the present invention will be best understood through the following descriptions with reference to the accompanying drawings, wherein:

DETAILED DESCRIPTION OF THE PREFERRED EMBODIMENT

Several preferred embodiments embodying the features and advantages of the present invention will be expounded in following paragraphs of descriptions. It is to be realized that the present invention is allowed to have various modification in different respects, all of which are without departing from the scope of the present invention, and the description herein and the drawings are to be taken as illustrative in nature, but not to be taken as limitative.

Figure 1:
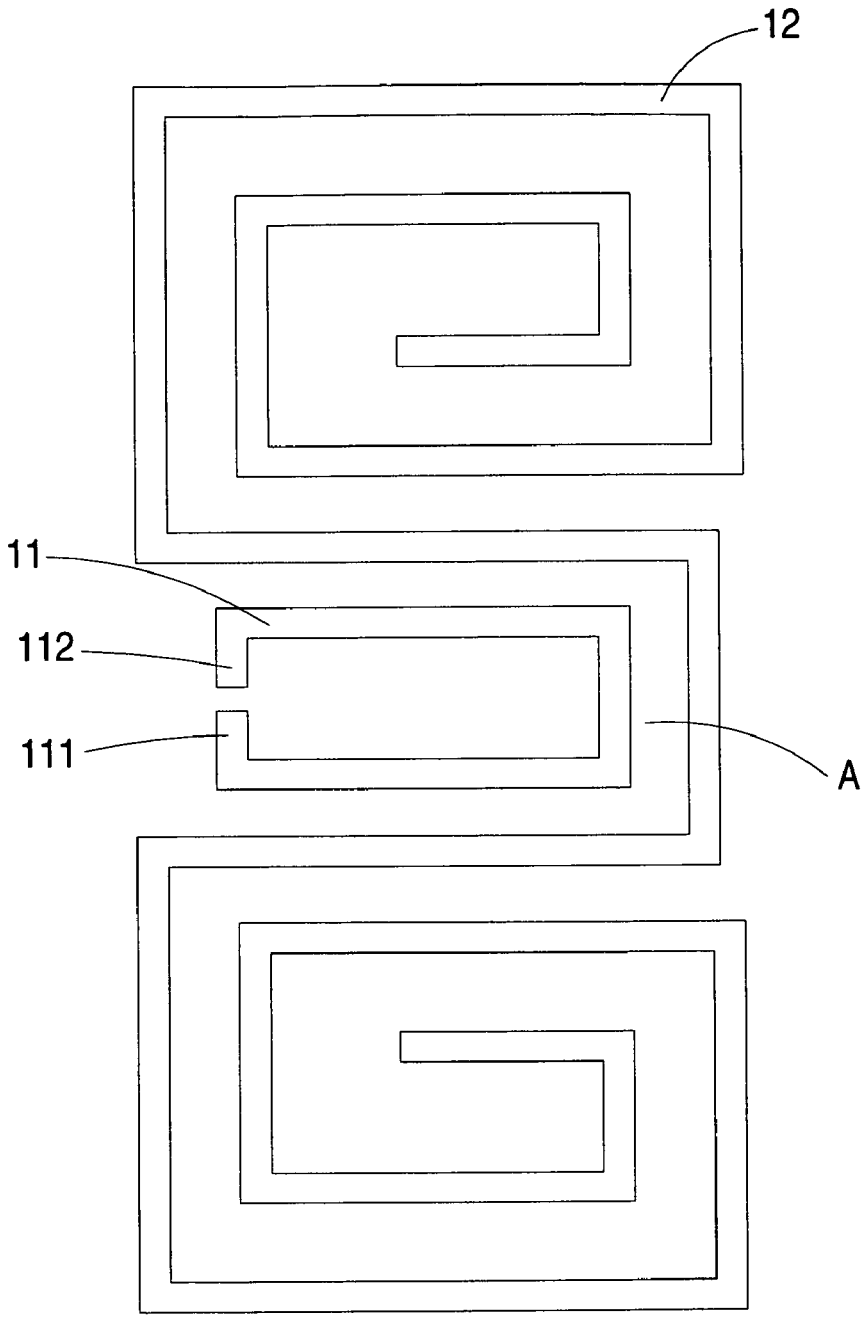
Fig. 1 (PRIOR ART)
FIG. 1 is a plan view showing a conventional antenna for using in a RFID tag.
Figure 2:
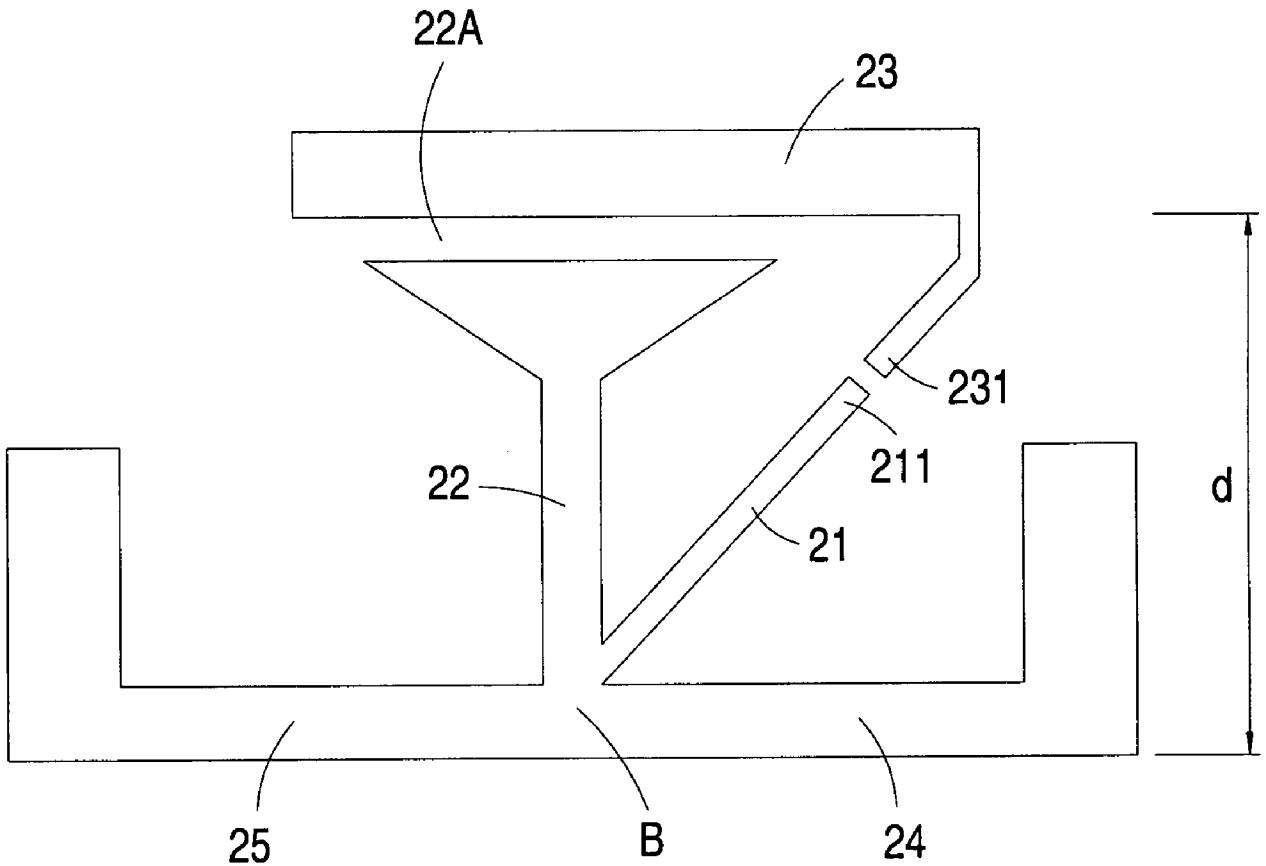
FIG. 2 is a plan view showing a high-directional wide-bandwidth antenna for using in a RFID tag according to a preferred embodiment of the present invention.

Referring to FIG. 2, a high-directional wide-bandwidth antenna for using in a RFID tag according to the present invention is shown. The inventive high-directional wide-bandwidth antenna 2 comprises a first element 21, a first radiating body 22, a second radiating body 23, a third radiating body 24, and a fourth radiating body 25, wherein the first element 21 is essentially composed of a conductor and having one end serving as a first feeding point 211. In the present embodiment, the length of the first element 21 is shorter than one-quarter wavelength of the first element 21, so that the electricity of the first feeding point 211 is equivalent to an inductive reactance. One end of the first radiating body 22 is connected to the first element 21, and the other end of the first radiating body 22 is a coupling surface 22A. One end of the second radiating body 23 serves as a second feeding point 231, and the second radiating body 23 can be extended to the coupling surface 22A of the first radiating body 22 through the second feeding point 231. Therefore, energy can be transferred between the first radiating body 22 and the second radiating body 23 through the coupling surface 22A. One end of the third radiating body 24 is connected to the first radiating body 22 and the first element 21; the other end of the third radiating body 24 extends outwardly in a direction being perpendicular to the extending direction of the first radiating body 22. One end of the fourth radiating body 25 is connected to the first radiating body 22, the third radiating body 24 and the first element 21; the other end of the fourth radiating body 25 extends outwardly in a direction being perpendicular to the extending direction of the first radiating body 22.

Referring to FIG. 2, the first radiating body 22 and the second radiating body 23 attain a first resonant frequency f1, wherein the length of the first radiating body 22 and the length of the second radiating body 23 are one-quarter of the wavelength of the first resonant frequency f1. In addition, the third radiating body 24 and the fourth radiating body 25 attain a second resonant frequency f2, wherein the length of the third radiating body 24 and the length of the fourth radiating body 25 are one-quarter of the wavelength of the second resonant frequency f2. In alternative embodiments, the first resonant frequency f1 is substantially smaller than the second resonant frequency f2. In addition, the length of the first element 21 is substantially shorter than one-quarter of the wavelength of the frequency of the first element 21, wherein the frequency of the first element 21 is located between the first resonant frequency f1 and the second resonant frequency f2.

In the present embodiment, the first resonant frequency f1 and the second resonant frequency f2 can be, but not limited to, 890 MHz and 990 MHz, respectively, and the length of the first element 21 is shorter than one-quarter of the wavelength of the frequency of the first element 21, for example, 940 MHz, wherein the frequency of the first element 21 (940 MHz) is located between the first resonant frequency f1 and the second resonant frequency f2. Those of skilled in the art will appreciate that, the electricity of the joint B that connects the first radiating body 22, the third radiating body 24, the fourth radiating body 25, and the first element 21 is a short circuit. Also, the electricity of the outer side of the first radiating body 22, the second radiating body 23, the third radiating body 24, and the fourth radiating body 25 is an open circuit. Therefore, the current of the first radiating body 22, the third radiating body 24 and the fourth radiating body 25 will be separated with each other by a phase difference of 90°. Also, a spatial difference of 90° will exist between the current of the first radiating body 22, the third radiating body 24 and the fourth radiating body 25, and the gap d will be one-quarter of the wavelength of the first resonant frequency f1 or one-quarter of the wavelength of the second resonant frequency f2. Therefore, the high-directional wide-bandwidth antenna 2 can provide a focusing effect.

Figure 5:
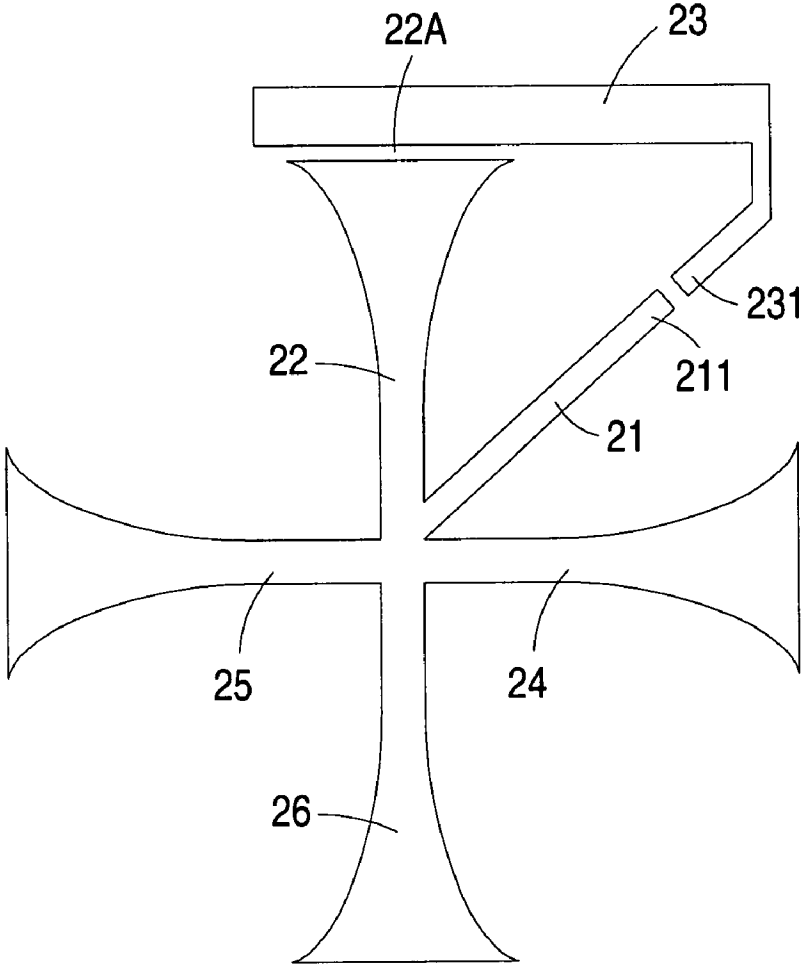
FIG. 5 is a plan view showing a high-directional wide-bandwidth antenna for using in a RFID tag according to another preferred embodiment of the present invention.

Certainly, in order to reduce the area of the high-directional wide-bandwidth antenna 2, the outwardly-extending ends of the third radiating body 24 and the fourth radiating body 25 can be curved-shaped. In alternative embodiments, the area of the third radiating body 24 and the fourth radiating body 25 can be enlarged to increase the amount of radiation for the third radiating body 24 and the fourth radiating body 25. Besides, as shown in FIG. 5, the high-directional wide-bandwidth antenna 2 can include a fifth radiating body 26 to achieve a better radiating effect, wherein one end of the fifth radiating body 26 is connected to the first radiating body 22, the third radiating body 24, the fourth radiating body 25, and the first element 21; the other end of the fifth radiating body 26 extends outwardly in a direction being perpendicular to the extending direction of the third radiating body 24 and the extending direction of the fourth radiating body 25. The fifth radiating body 26 attains the first resonant frequency f1, and thus the length of the fifth radiating body 26 is one-quarter of the wavelength of the first resonant frequency f1. In addition, the outwardly-extending end of the fifth radiating body 26 can be curved-shaped and/or has a radiating surface being larger than the width of the inner periphery.

Figure 3:
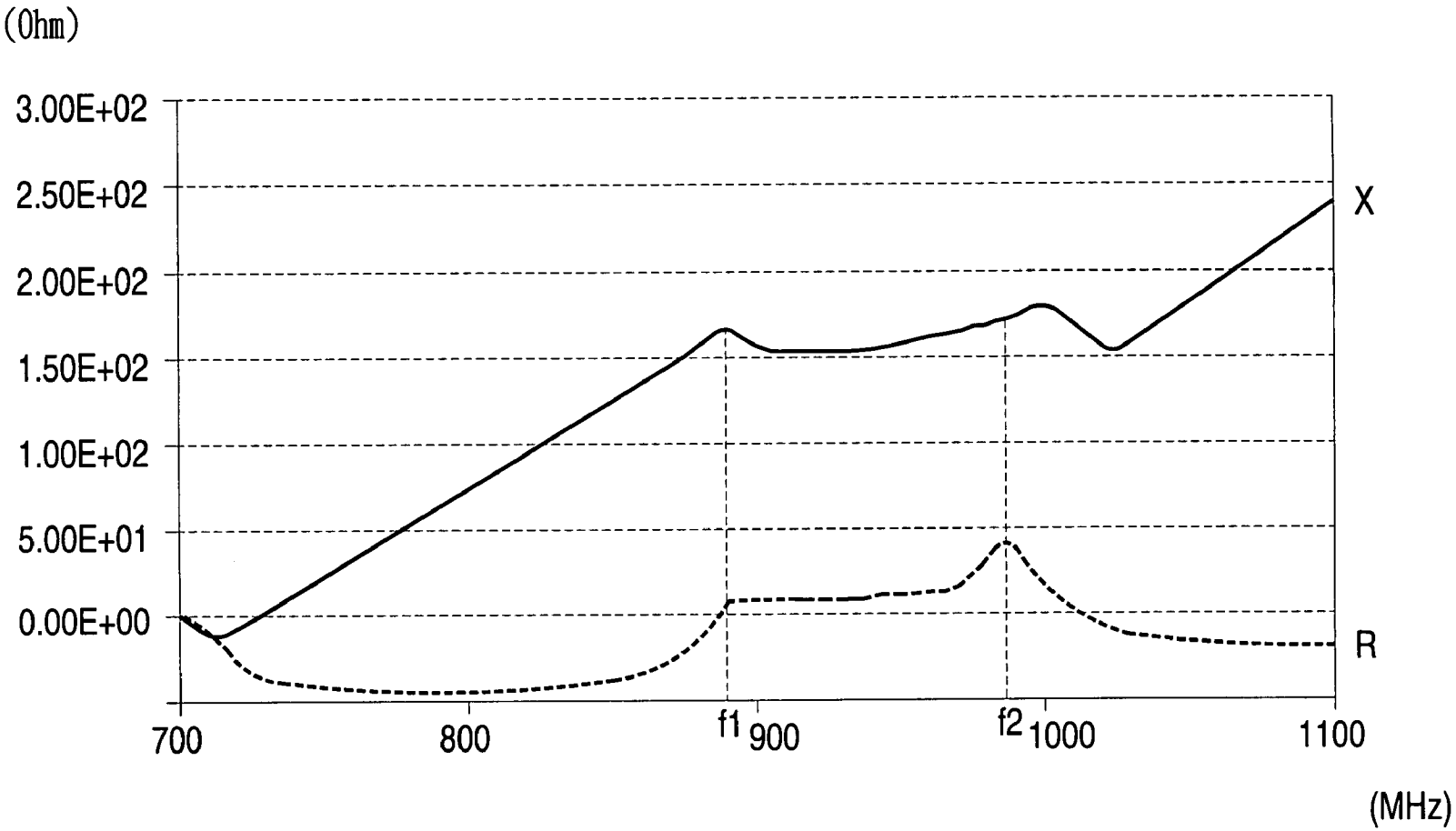
FIG. 3 is a characteristic plot showing the impedance versus frequency relationship of the high-directional wide-bandwidth antenna according to the present invention.

Referring to FIG. 3, the impedance versus frequency relationship of the high-directional wide-bandwidth antenna according to the present invention is shown. As shown in FIG. 3, the equivalent impedance of the antenna 2 includes a resistance R and a reactance X, and a peak value for the resistance R is generated at each resonant frequency. The change of the resistance R and the reactance X is relatively low between the first resonant frequency f1 and the second resonant frequency f2. This is similar to the conjugate impedance of the RFID IC. Hence, the high-directional wide-bandwidth antenna 2 can provide a conjugate-matching compensating effect for the RFID IC.

Figure 4:
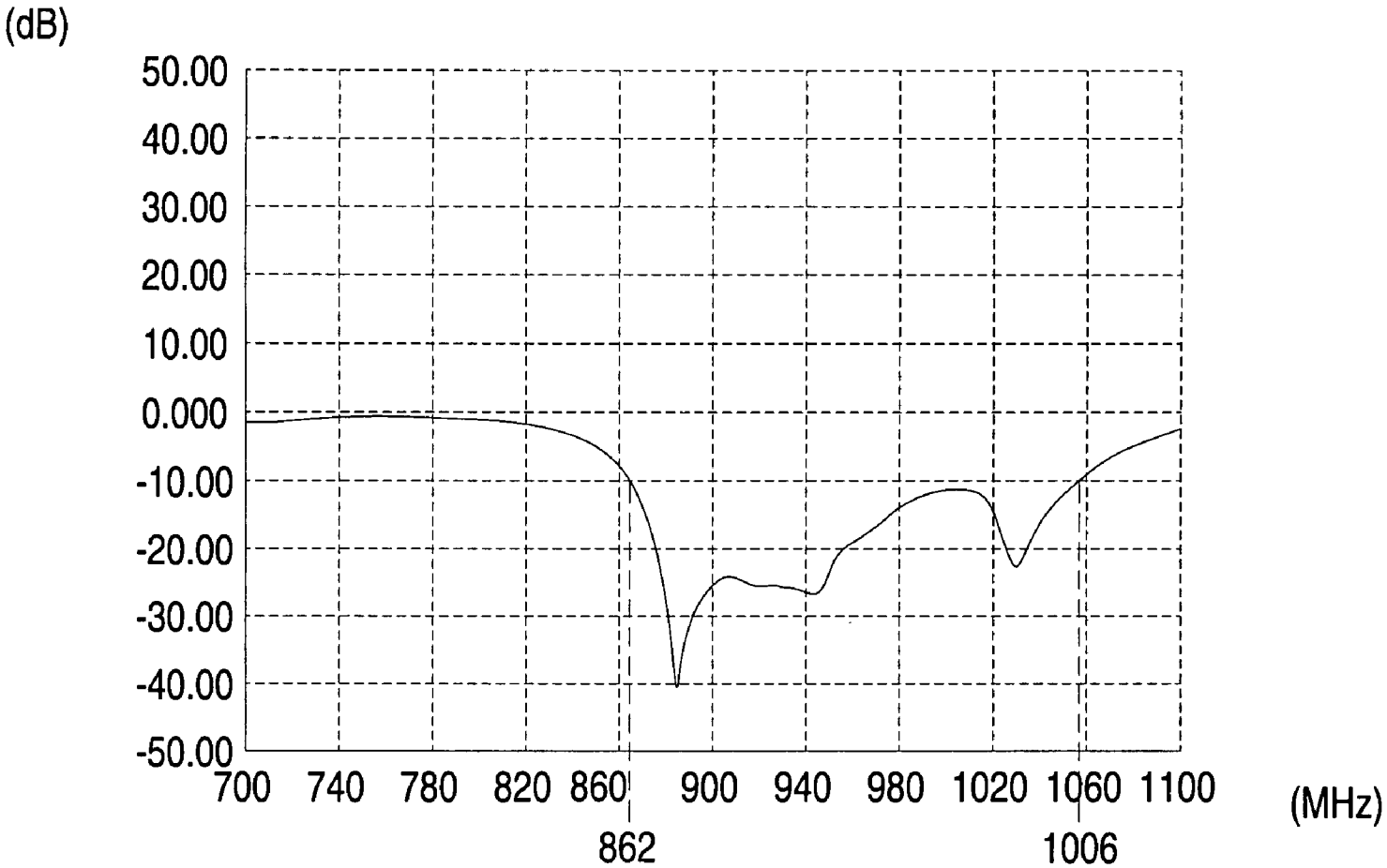
FIG. 4 is a frequency response diagram of the high-directional wide-bandwidth antenna according to the present invention.

Referring to FIG. 4, a frequency response diagram of the high-directional wide-bandwidth antenna according to the present invention is shown. As shown in FIG. 4, since the high-directional wide-bandwidth antenna 2 can provide a conjugate-matching compensating effect for the RFID IC between the first resonant frequency f1 and the second resonant frequency f2, the frequency range available to the high-directional wide-bandwidth antenna 2 will be located between the first resonant frequency f1 and the second resonant frequency f2. In the present embodiment, the first resonant frequency f1 and the second resonant frequency f2 are 890 MHz and 990 MHz, respectively, whereas the frequency range available to the high-directional wide-bandwidth antenna 2 is 862-1006 MHz. It should be noted that the frequency range available to the high-directional wide-bandwidth antenna 2 is approximate to the frequency band ranged between the first resonant frequency f1 and the second resonant frequency f2.

In conclusion, the high-directional wide-bandwidth antenna according to the present invention accommodates two resonant frequencies, thereby broadening the bandwidth and allowing the antenna to be applicable to multi-frequency RFID tag. The frequency band of the antenna according to the present invention can be, for example, 860-1006 MHz. In addition, the antenna is an array-type antenna and thus the antenna has a high directionality. This would lengthen the reading distance for the RFID tag.

Those of skilled in the art will recognize that these and other modifications can be made within the spirit and scope of the present invention as further defined in the appended claims.

What is claimed is:

1. A high-directional wide-bandwidth antenna for using in a RFID tag, comprising:

a first element comprising a conductor and having one end serving as a first feeding point, wherein an electricity of the first feeding point is equivalent to an inductive reactance;

a first radiating body having one end connected to the first element and the other end being a coupling surface;

a second radiating body having one end serving as a second feeding point, wherein the second radiating body extends to the coupling surface of the first radiating body through the second feeding point, such that energy is transferred between the first radiating body and the second radiating body through the coupling surface;

a third radiating body having one end connected to the first radiating body and the first element, and the other end extending outwardly; and a fourth radiating body having one end connected to the first radiating body, the third radiating body and the first element, and the other end extending outwardly;

wherein the first radiating body and the second radiating body attain a first resonant frequency, and the third radiating body and the fourth radiating body attain a second resonant frequency.

2. The high-directional wide-bandwidth antenna according to claim 1, further comprising a fifth radiating body having one end connected to the first radiating body, the third radiating body, the fourth radiating body and the first element, and the other end extending outwardly.

3. The high-directional wide-bandwidth antenna according to claim 2, wherein the fifth radiating body attains the first resonant frequency.

4. The high-directional wide-bandwidth antenna according to claim 2, wherein the length of the fifth radiating body is substantially one-quarter of the wavelength of the first resonant frequency.

5. The high-directional wide-bandwidth antenna according to claim 2, wherein an extending direction of the fifth radiating body is substantially perpendicular to an extending direction of the third radiating body and an extending direction of the fourth radiating body.

6. The high-directional wide-bandwidth antenna according to claim 2, wherein the fifth radiating body has a curved-shaped outwardly-extending end and/or a radiating surface being larger than the width of an inner periphery.

7. The high-directional wide-bandwidth antenna according to claim 1, wherein the length of the first radiating body and the length of the second radiating body are one-quarter of the wavelength of the first resonant frequency.

8. The high-directional wide-bandwidth antenna according to claim 1, wherein the length of the third radiating body and the length of the fourth radiating body are one-quarter of the wavelength of the second resonant frequency.

9. The high-directional wide-bandwidth antenna according to claim 1, wherein an extending direction of the first radiating body is substantially perpendicular to an extending direction of the third radiating body and an extending direction of the fourth radiating body.

10. The high-directional wide-bandwidth antenna according to claim 1, wherein each of the third radiating body and the fourth radiating body has a curved-shaped outwardly-extending end and/or a radiating surface being larger than the width of an inner periphery.

11. The high-directional wide-bandwidth antenna according to claim 1, wherein the first resonant frequency is smaller than the second resonant frequency.

12. The high-directional wide-bandwidth antenna according to claim 1, wherein the first resonant frequency is substantially 890 MHz.

13. The high-directional wide-bandwidth antenna according to claim 1, wherein the second resonant frequency is substantially 990 MHz.

14. The high-directional wide-bandwidth antenna according to claim 1, wherein the length of the first element is shorter than one-quarter of a frequency of the first element, and the frequency of the first element is located between the first resonant frequency and the second resonant frequency.

15. The high-directional wide-bandwidth antenna according to claim 14, wherein the frequency of the first element is between the first resonant frequency and the second resonant frequency.

16. The high-directional wide-bandwidth antenna according to claim 14, wherein a gap between the first radiating body and the third radiating body and the fourth radiating body is substantially one-quarter of the wavelength of the first resonant frequency or one-quarter of the wavelength of the second resonant frequency.

* * * * *